United States Patent [19]

Gardner

[11] 4,089,411

[45] May 16, 1978

[54] HANGER SUPPORTING ARRANGEMENT

[75] Inventor: Jeffrey M. Gardner, Wheaton, Ill.

[73] Assignee: Container Corporation of America, Chicago, Ill.

[21] Appl. No.: 817,151

[22] Filed: Jul. 20, 1977

[51] Int. Cl.[2] ..... B65D 73/00; B65D 85/00

[52] U.S. Cl. ..... 206/300; 206/482; 206/493; 248/174

[58] Field of Search ..... 206/45.14, 279, 288, 206/300, 303–304, 396, 453, 482, 491, 493, 495, 586; 229/14 C, 42, 87 S, DIG. 1; 248/150, 152, 174

[56] References Cited

U.S. PATENT DOCUMENTS

| | | | |
|---|---|---|---|
| 1,626,381 | 4/1927 | Batts | 206/279 |
| 2,509,468 | 5/1950 | Anderson, Jr. | 206/586 X |
| 2,797,855 | 7/1957 | Moore | 229/42 |
| 3,494,534 | 2/1970 | McFarland et al. | 229/14 C |

*Primary Examiner*—Steven E. Lipman
*Attorney, Agent, or Firm*—Carpenter & Ostis

[57] ABSTRACT

A hanger support arrangement for a garment box which includes a positioning pad having cut therefrom a pair of elements which are folded together to form a hanger supporting strut.

8 Claims, 5 Drawing Figures

HANGER SUPPORTING ARRANGEMENT

SUMMARY OF THE INVENTION

This invention relates to garment boxes and more particularly to an internal hanger supporting arrangement.

It is an object of the invention to provide an inner packaging member for a garment shipping container which includes integral means for forming a strut adapted to support one or more hangers.

A more specific object of the invention is the provision of an internal supporting arrangement including a base panel having cut therefrom and foldably joined thereto a pair of elements which are folded together in interlocking relation to form a hanger supporting strut.

These and other objects of the invention will be apparent from an examination of the following description and drawings.

THE DRAWINGS

Figure 1:
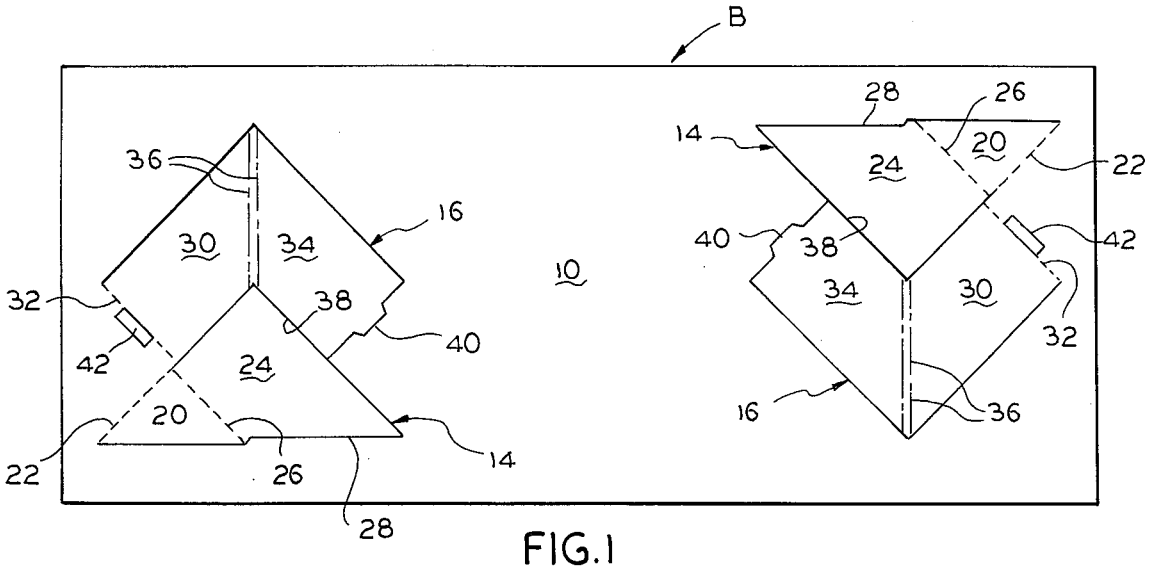
FIG. 1 is a plan view of a blank of foldable paperboard from which the hanger supporting arrangement illustrated in the other views may be formed.

It will be understood that, for purposes of clarity, certain elements may have been intentionally omitted from certain views where they are believed to be illustrated to better advantage in other views.

THE DESCRIPTION

Referring now to the drawings for a better understanding of the invention, it will be understood that the invention comprises an internal hanger supporting arrangement indicated generally at A in FIG. 5 which may be formed from a unitary blank of foldable paperboard indicated generally at B in FIG. 1, which is adapted to be inserted within an outer container or garment box (not shown) for use in supporting a plurality of garment hangers H in a manner hereinafter described.

Figure 5:
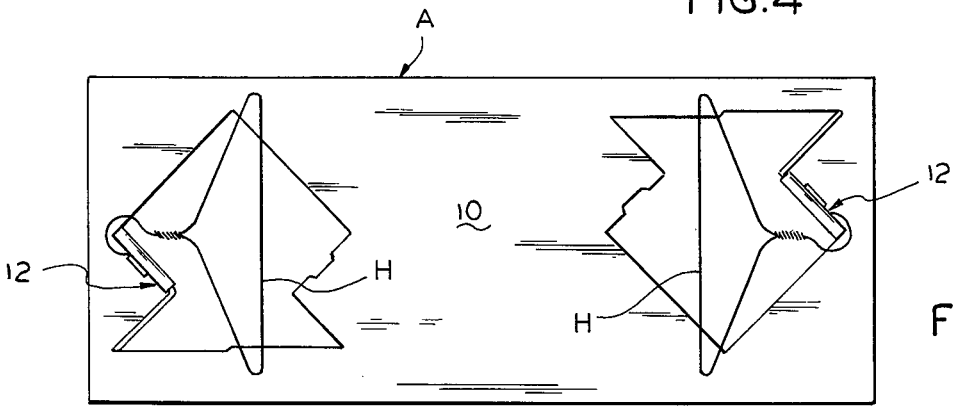
FIG. 5 is a top plan view of the base panel with a pair of struts shown in completely erected position.

Although the arrangement shown in FIG. 5 illustrates a pair of struts or supporting members 12 projecting from an insertable positioning pad or base panel 10, the arrangement may be provided with a single strut if so desired.

Figure 2:
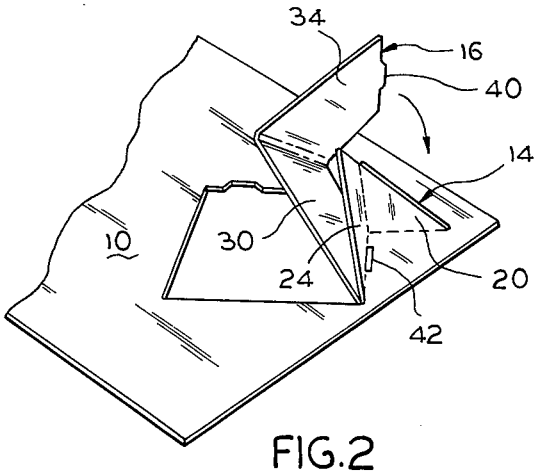
FIG. 2 is a perspective view showing the manner in which the hanger supporting strut is folded into erected position.
Figure 3:
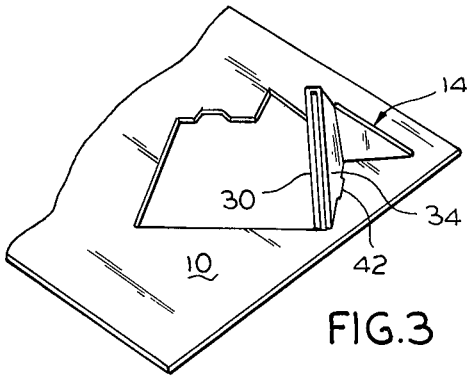
FIG. 3 is a perspective view showing the hanger supporting strut of the invention in a completely erected position.
Figure 4:
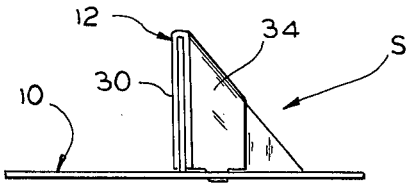
FIG. 4 is a side elevation of the strut illustrated in FIG. 3.

As best seen in FIGS. 1 and 2, there is provided a preferably rectangular unitary blank of foldable paperboard B which forms a positioning pad or base panel 10 from which the material used to form the struts 12 is cut.

Each of the struts or supporting members 12 comprises a pair of inner and outer members 14 and 16, respectively, which are folded together in interlocking relation with each other and with base panel 10 to form a rigid supporting member. As best seen in FIG. 1, inner support member 14 includes a preferably triangular first section 20 foldably joined at one side edge along a fold line 22 to base panel 10 and a preferably trapezoid shaped second section 24 which is foldably joined along one short side edge to another side edge of first section 20 along fold line 26 which converges with fold line 22 at right angles therewith. Inner member second section 24 includes a sloping end edge 28.

Outer support member 30 includes a pair of generally trapezoidal first and second sections 30 and 34, respectively, which are generally congruent to each other and to inner support member second section 24.

Outer support member first section 30 is foldably joined at one end edge to base panel 10 along a fold line 32 which is parallel to previously mentioned fold line 26. Fold lines 32 and 26 are in general alignment with each other but may be offset slightly from each other. Outer support member second section 34 is foldably joined along one end edge to opposite end edge of outer support member first section 30 along a fold line 36 which is preferably in the form of a pair of parallel score lines which extend at an angle of less than 90° with respect to fold line 32. It will be noted that outer member second section 34 includes a short side edge 38 which will be referred to hereinafter in the specification.

In erecting the device, inner member first section 20 is folded upwardly at right angles to base panel 10 and inner member second section 24 is folded at right angles to first section 20. At the same time outer member first section 30 is folded upwardly at right angles to base 10 so as to lie in face-to-face relation with one side of inner member second section 24. Outer member second section 34 is then folded downwardly 180° about fold lines 36 so as to lie in face-to-face relation with opposite side of inner member second section 24. Thus inner member second section 24 is sandwiched between the two sections of the outer member with its diagonal edge 28 lying adjacent fold line 36 and with the side edge 38 of outer member second section 34 lying adjacent fold line 26.

In order to retain the supporting strut in rigid erected condition, outer member second section 34 is provided at its free edge with a lock tab 40 adapted to be received within a complementary slot 42 located in base panel 10 immediately adjacent fold line 32.

Thus it will be understood that there is provided a self contained hanger supporting arrangement in the form of struts projecting from a panel, which panel may be inserted into an outer container so as to provide a means for supporting hangers and keeping them in proper position within the container during shipping.

When a pair of struts are provided on a common pad as shown in FIG. 5, it will be understood that the clothes packed in the container are not intended to "hang", but rather are packed in the container with alternate items being supported by opposite struts to prevent the clothes from shifting in the container. When the container is open, the hangers may be lifted out of the box and displayed on racks in a conventional manner.

I claim:

1. A hanger support arrangement, formed of a unitary blank of foldable paperboard, for a garment container, comprising:

(a) a relatively thin, flat base panel;

(b) a hanger supporting structure including a pair of inner and outer members formed of material cut from said base panel;

(c) said inner member including:

(i) a first element foldably joined at one edge to said base panel;

(ii) a second element foldably joined at one edge to another edge of said first element;

(d) said outer member including:

(i) a first element foldably joined at one edge to said base panel;

(ii) a second element foldably joined at one edge to another edge of said outer member first element;

(e) the elements of said inner member being folded normal to each other, and the elements of said outer member being folded into parallel relationship with each other, with the second element of said inner member being interposed between the elements of said outer member to provide said supporting structure;

(f) said outer member second element having interlocking relationship with said base panel to maintain said structure in erected condition;

(g) said second element of said inner member and both elements of said outer member having substantially similar configurations.

2. An arrangement according to claim 1, wherein said second element of said inner member and both elements of said outer member have trapezoidal shape.

3. An arrangement according to claim 1, wherein said second element of said inner member and both elements of said outer member have triangular shape.

4. An arrangement according to claim 1, wherein the fold line between said inner members is in substantial alignment with the fold line between said outer member first element and said base panel.

5. An arrangement according to claim 1, wherein the fold line between said inner member elements converges at a right angle with the fold line between said inner member first section and said base panel.

6. An arrangement according to claim 1, wherein said outer member second element has projecting from a free end thereof a locking tab which is received within a slot in said base panel, located adjacent the fold line between said outer member first element and said base panel, to provide said interlocking relationship.

7. An arrangement according to claim 1, wherein said supporting structure projects at a right angle to said base panel.

8. An arrangement according to claim 1, wherein said arrangement includes a plurality of hanger supporting structures cut from and joined to said base panel.

* * * * *